US007664287B2

(12) United States Patent
Neu et al.

(10) Patent No.: US 7,664,287 B2
(45) Date of Patent: Feb. 16, 2010

(54) HEADSET CAPABLE OF RECEIVING SIGNALS FROM AN ELECTRONIC DEVICE, METHOD OF MANUFACTURING SAME, AND EAR LOOP AND EARPLUG CAPABLE OF REMOVABLE ENGAGEMENT WITH SAME

(75) Inventors: Thorben Neu, Los Angeles, CA (US); Vijendra Nalwad, Newbury Park, CA (US); Carlos del Toro, Whittier, CA (US)

(73) Assignee: Belkin International, Inc., Compton, CA (US)

( * ) Notice: Subject to any disclaimer, the term of this patent is extended or adjusted under 35 U.S.C. 154(b) by 926 days.

(21) Appl. No.: 11/031,028

(22) Filed: Jan. 6, 2005

(65) Prior Publication Data

US 2006/0147078 A1 Jul. 6, 2006

(51) Int. Cl.
*H04R 25/00* (2006.01)

(52) U.S. Cl. ..... 381/381; 381/380; 381/374

(58) Field of Classification Search ..... 381/23.1, 381/309, 314, 323, 326, 328, 370, 371, 374, 381/375, 380, 381, 376, 378; 379/430, 420.02, 379/433.02; 455/575.1, 575.2, 569.1; 181/129, 181/130, 135, 128

See application file for complete search history.

(56) References Cited

U.S. PATENT DOCUMENTS 6,154,539 A * 11/2000 Pitel ..... 379/430
6,760,459 B2 * 7/2004 Bae ..... 381/375
6,771,790 B2 * 8/2004 Liu ..... 381/385
7,409,234 B2 * 8/2008 Glezerman ..... 455/569.1

* cited by examiner

*Primary Examiner*—Huyen D Le
(74) *Attorney, Agent, or Firm*—Bryan Cave LLP

(57) ABSTRACT

A headset capable of receiving signals from an electronic device includes a body (110), a neck (120) protruding from the body, a speaker (130) coupled to the neck, an ear loop (140) removably attached to the neck, and an earplug (150) removably attached to the neck. The ear loop can include an attachment portion (810) including a substantially circular arc, and an ear engagement portion (820) coupled to the headset attachment portion and including a flexible wire (821) surrounded by a coating (822). The earplug can include a neck attachment portion (1110) and an ear engaging portion (1120) adjacent to the headset engaging portion and having a protruding lip (1121).

35 Claims, 3 Drawing Sheets

HEADSET CAPABLE OF RECEIVING SIGNALS FROM AN ELECTRONIC DEVICE, METHOD OF MANUFACTURING SAME, AND EAR LOOP AND EARPLUG CAPABLE OF REMOVABLE ENGAGEMENT WITH SAME

FIELD OF THE INVENTION

This invention relates generally to communication devices, and relates more particularly to headsets for communication devices.

BACKGROUND OF THE INVENTION

Certain electronic devices, such as cellular telephones, radios, and the like, operate in part by transmitting audio signals through a speaker to an ear of a user of the electronic device. On some such devices, the speaker is not capable of transmitting the audio signals such that they can be heard clearly at a distance, thus requiring those devices, or the speakers of those devices, to be held directly to the ear. Privacy, courtesy, and other considerations sometimes dictate that speakers on electronic devices also be held directly to the ear even where this is not a requirement of the device. Headphones, earpieces, headsets, and the like have been developed that allow users of electronic devices to position a speaker next to or in the ear without having to hold the speaker in place. However, the existing headphones, earpieces, headsets, and the like, while offering certain useful features, do not offer the flexibility necessary to provide a secure, comfortable fit customizable for both left and right ears in a variety of shapes and sizes, and/or customizable for a variety of individual preferences. Accordingly, there exists a need for a headset capable of use with an electronic device and that is capable of a comfortable, secure, customizable, and reconfigurable fit on a user's ear.

BRIEF DESCRIPTION OF THE DRAWINGS

The invention will be better understood from a reading of the following detailed description, taken in conjunction with the accompanying figures in the drawings in which.

Figure 1:
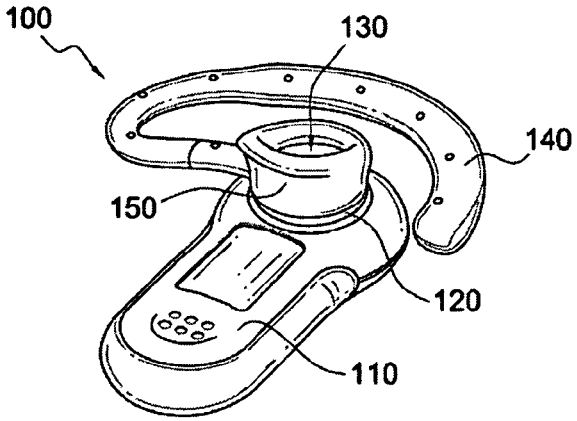
FIG. 1 is a perspective view of a headset according to an embodiment of the invention.

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments of the invention described herein are, for example, capable of operation in sequences other than those illustrated or otherwise described herein. Furthermore, the terms "comprise," "include," "have," and any variations thereof, are intended to cover a non-exclusive inclusion, such that a process, method, article, or apparatus that comprises a list of elements is not necessarily limited to those elements, but may include other elements not expressly listed or inherent to such process, method, article, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein. The term "coupled," as used herein, is defined as directly or indirectly connected in an electrical, mechanical, or other manner.

DETAILED DESCRIPTION OF THE DRAWINGS

In one embodiment of the invention, a headset capable of receiving signals from an electronic device comprises a body, a neck protruding from the body, a speaker coupled to the neck, an ear loop removably attached to the neck, and an earplug removably attached to the neck. The ear loop can comprise a headset attachment portion comprising a substantially circular arc and an ear engagement portion coupled to the headset attachment portion and comprising a flexible wire surrounded by a coating. The earplug can comprise a headset engaging portion comprising a first ring and an ear engaging portion adjacent to the headset engaging portion and comprising a second ring having a protruding lip.

FIG. 1 is a perspective view of a headset 100 according to an embodiment of the invention. Headset 100 is capable of receiving signals from an electronic device such as, for example, a cellular telephone (cell phone), a radio, a vehicle navigation system, and the like. In the following description, headset 100 will be described in terms of use with a cell phone, but it should be understood that headset 100 may also be used with a variety of other electronic devices, including those mentioned above.

As illustrated in FIG. 1, headset 100 comprises a body 110, a neck 120 protruding from body 110, a speaker 130 coupled to, or adjacent to, neck 120, and an ear loop 140 and an earplug 150 removably attached to neck 120. The structure of ear loop 140 and of earplug 150 will be discussed in detail below. In one embodiment, headset 100 further comprises a magnet inside body 110. The magnet referred to is not a magnet that may be part of speaker 130, but instead is separate from speaker 130. In the same or another embodiment, headset 100 further comprises a rechargeable battery inside body 110. Because of their location inside body 110, and because they are both known in the art, neither the magnet nor the rechargeable battery are illustrated in the figures.

As an example of how headset 100 may be used, ear loop 140 and earplug 150 can be placed, respectively, over and in the ear of a cell phone user so as to securely position speaker 130 in a location where the user can hear the sounds being transmitted through speaker 130. With headset 100 securely in place in the user's ear, the user need not hold the cell phone at all, thus keeping the hands free to perform other tasks. As a particular example, headset 100 allows a driver of a vehicle to grasp the steering wheel of the vehicle with both hands rather than use one hand to hold the cell phone, thus promoting and increasing the safety of the roadways.

In at least one embodiment, headset 100 is a wireless headset allowing hands-free communication between it and a wireless-enabled host such as a Bluetooth computer, cell phone, or other device. Headset 100 may also be used, without wires, in connection with non wireless-enabled devices, provided an appropriate dongle is used. Such dongles are known in the art and will therefore not be further described herein. Headset 100 may further be used in connection with a transceiver enhancing, for example, use of headset 100 in a vehicle. As an example, the transceiver may be capable of providing power to operate headset 100, and/or recharge the battery therein, via the vehicle's cigarette lighter adapter. As another example, the transceiver may be capable of serving as a dock or mounting receptacle for headset 100, and may comprise a built-in speaker and microphone to allow headset 100 to function as a speakerphone when headset 100 is docked with or mounted on the transceiver.

Figure 2:
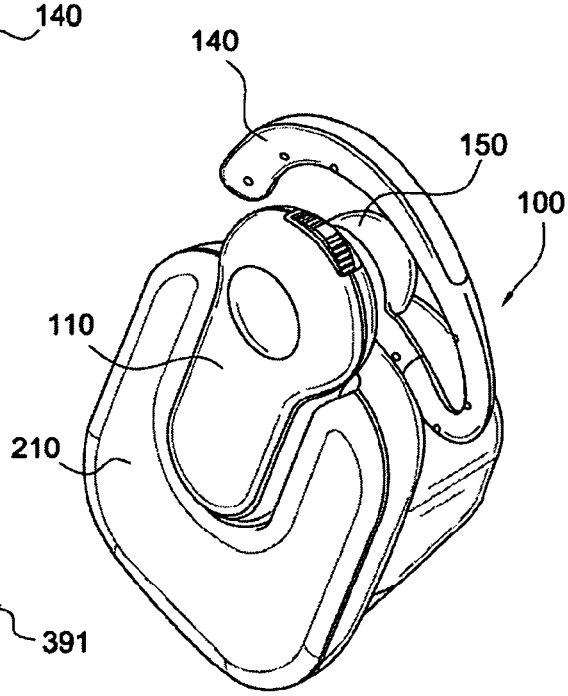
FIG. 2 is a perspective view of a headset and a charger according to an embodiment of the invention.

FIG. 2 is a perspective view of headset 100 and a charger 210 according to an embodiment of the invention. As illustrated in FIG. 2, headset 100 can be placed in charger 210 in what is referred to herein as a charging position. The rechargeable battery inside body 110 is capable of being recharged by charger 210 when headset 100 is placed in the charging position on charger 210. In one embodiment, charger 210 has a second magnet therein configured to attract the magnet inside body 110 of headset 100. Headset 100 is thus maintained in the charging position on charger 210 by the mutual attraction of the magnet and the second magnet. In an alternate embodiment, only one of charger 210 and headset 100 contains a magnet, and the piece having no magnet contains instead a component that is attracted to magnets. In this alternate embodiment, headset 100 is also maintained in the charging position on charger 210, though perhaps not as securely as in the two-magnet embodiment described above. Because of its location inside charger 210, and because it is a component known in the art, the second magnet is not illustrated in the figures.

Figure 3:
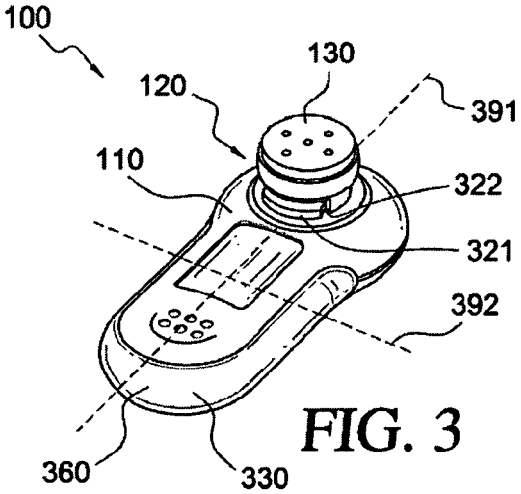
FIG. 3 is a perspective view of a portion of the headset according to an embodiment of the invention.
Figure 4:
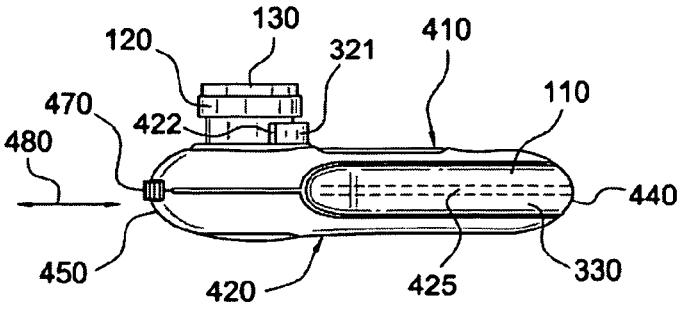
FIG. 4 is an elevational view of the portion of the headset of FIG. 3 according to an embodiment of the invention.

FIG. 3 is a perspective view of a portion of headset 100 including body 110, neck 120, and speaker 130, according to an embodiment of the invention. FIG. 4 is an elevational view of the same portion of headset 100 according to an embodiment of the invention. As illustrated in FIGS. 3 and 4, body 110 comprises a side 410, a side 420 substantially opposite side 410, and an end cap 330 covering a portion of side 410 and a portion of side 420. An intersection of side 410 and side 420 comprises a raised centerline 425, shown in dashed lines to indicate that it is located underneath end cap 330 in FIG. 4. Neck 120 protrudes substantially perpendicularly from side 410. Body 110 further comprises an end 440, an end 450 substantially opposite end 440, a microphone 360 at end 440, and a switch 470 at end 450. End cap 330 covers end 440 in addition to the portion of side 410 and the portion of side 420 mentioned above.

Switch 470 is capable of at least one of rotational and linear movement. More specifically, switch 470 can either be rotated in both the clockwise and counterclockwise directions, or can be pushed and released so that it retreats slightly into and rebounds from end 450 of body 110. Accordingly, in the context of switch 470, linear movement means movement into and out of body 110 substantially in the direction of an arrow 480 shown in FIG. 4. In one embodiment, switch 470 is capable of both of the described motions. As an example, rotational movement of switch 470 can control the volume of audio signals emanating from speaker 130. As another example, linear movement of switch 470 can perform call-answering and/or call-terminating functions. Continuing with the call-answering/call-terminating example, switch 470 can be pushed and released once in order to answer an incoming telephone call, and be pushed and released a second time in order to hang up after the telephone call has concluded.

In the illustrated embodiment, body 110 is an elongated or elliptical body having a major axis 391 and a minor axis 392 substantially perpendicular to major axis 391. Switch 470 and microphone 360 are located substantially at opposite ends of major axis 391.

Figure 5:
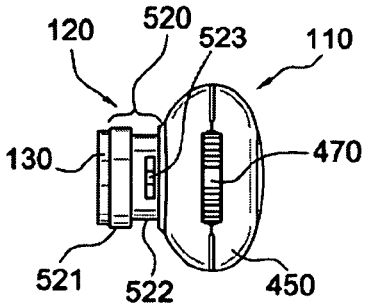
FIG. 5 is another elevational view of the portion of the headset of FIG. 3 according to an embodiment of the invention.

FIG. 5 is an elevational view of the portion of headset 100 illustrated in FIGS. 3 and 4, as seen from end 450 of body 110, according to an embodiment of the invention. As illustrated in FIG. 5, neck 120 comprises a portion 521 and a portion 522 between body 110 and portion 521. In the illustrated embodiment, both portion 521 and portion 522 are substantially circular, with portion 521 having a first diameter and portion 522 having a second diameter different from the first diameter. In a particular embodiment, the first diameter is greater than the second diameter.

As described in more detail below, ear loop 140 (FIG. 1) fits over or otherwise fits onto portion 522, and earplug 150 (FIG. 1) fits over or otherwise fits onto portion 521. Referring still to FIG. 5, and again to FIGS. 3 and 4, portion 522 of neck 120 comprises a shaft 520, an arcuate segment 321 protruding from and extending around a portion of shaft 520, a groove 322 in shaft 520 at a first side of arcuate segment 321, a groove 422 in shaft 520 at a second side of arcuate segment 321, and a groove 523 in shaft 520 substantially opposite arcuate segment 321.

Figure 6:
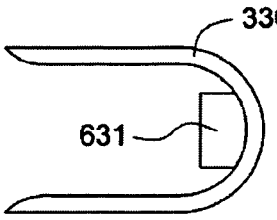
FIG. 6 is a plan view of another portion of the headset according to an embodiment of the invention.
Figure 7:
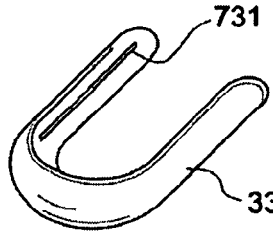
FIG. 7 is a perspective view of the portion of the headset of FIG. 6 according to an embodiment of the invention.

FIG. 6 is a plan view of end cap 330 according to an embodiment of the invention, and FIG. 7 is a perspective view thereof according to an embodiment of the invention. As illustrated in FIGS. 6 and 7, end cap 330 has a channel 731 formed therein. In one embodiment, end cap 330 further comprises a second, non-illustrated channel, similar to channel 731, located opposite channel 731 on an opposite interior sidewall of end cap 330. When end cap 330 is in place covering a portion of side 410 and a portion of side 420 (FIG. 4), channel 731 fits over raised centerline 425 (FIG. 4) formed by the intersection of side 410 and side 420 of body 110. In this manner, end cap 330 tends to urge side 410 and side 420 toward each other, thus helping to prevent sides 410 and 420 from separating. End cap 330 further comprises an enclosure 631 protruding therefrom. Enclosure 631 defines an opening in which microphone 360 (FIG. 3) rests.

Figure 8:
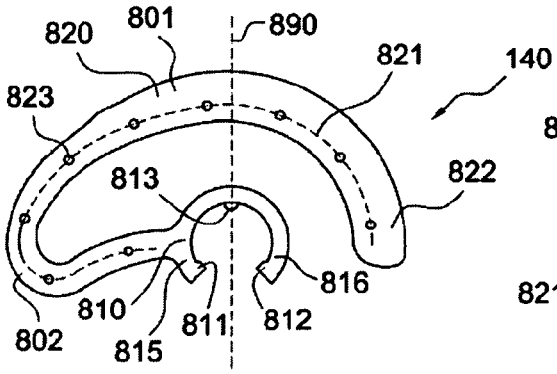
FIG. 8 is a plan view of an ear loop according to an embodiment of the invention.
Figure 9:
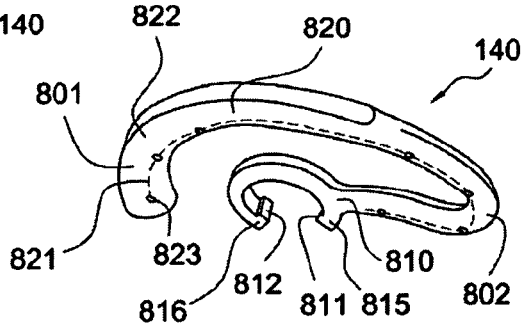
FIG. 9 is a perspective view of an ear loop according to an embodiment of the invention.
Figure 10:
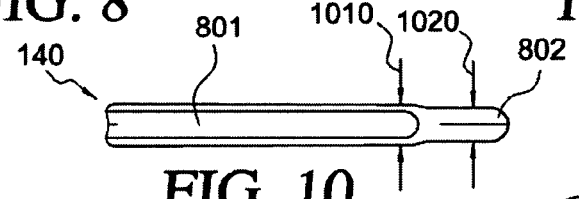
FIG. 10 is an elevational view of an ear loop according to an embodiment of the invention.

FIG. 8 is a plan view, FIG. 9 is a perspective view, and FIG. 10 is an elevational view of ear loop 140 according to an embodiment of the invention. As illustrated in FIGS. 8 and 9, ear loop 140 comprises an attachment portion 810 and an ear engagement portion 820 coupled to attachment portion 810. Attachment portion 810 comprises a substantially circular arc comprising a lip 811 at a side 815 of attachment portion 810, a lip 812 at a side 816 of attachment portion 810 substantially opposite side 815, and a tab 813 between lip 811 and lip 812. Attachment portion 810 is symmetric about an axis 890 passing through tab 813, meaning tab 813 is located substantially on an axis of symmetry of attachment portion 810.

In one embodiment, tab 813 is located substantially opposite arcuate segment 321. Lip 811 and lip 812 are sized to fit into groove 322 and into groove 422, while tab 813 is sized to fit into groove 523. Attachment portion 810 may be constructed of Acrylonitrile Butadiene Styrene (ABS), polycarbonate (PC), another plastic resin, or the like, and is capable of being flexed such that it may be snapped onto neck 120 (FIG. 1) with a gentle push and removed from neck 120 with a gentle tug. During both of such actions, attachment portion 810 flexes slightly as lips 811 and 812 pass over the widest part of neck 120.

Attachment of ear loop 140 to neck 120 comprises maneuvering attachment portion 810 onto neck 120 as described above until lip 811 is positioned either in groove 322 or groove 422, lip 812 is in the one of groove 322 and 422 not occupied by lip 811, and tab 813 is in groove 523. As an example, headset 100 (FIG. 1) can be said to be in a first orientation when lip 811 is in groove 322 and lip 812 is in groove 422, and in a second orientation when lip 811 is in groove 422 and lip 812 is in groove 322. As a further example, the first orientation may be suitable for a left ear of a user of headset 100, while the second orientation may be suitable for a right ear of the user. Headset 100 may be changed between the first and second orientations simply by removing ear loop 140 from neck 120 (FIG. 1), rotating ear loop 140 one hundred and eighty degrees about axis 890, and reattaching ear loop 140 on neck 120.

Referring still to FIG. 8, ear engagement portion 820 comprises a wire 821 and a coating 822 surrounding wire 821. Wire 821 is shown in dashed lines to indicate that it is located within coating 822. In the illustrated embodiment, ear engagement portion 820 further comprises holes 823 which may be used during the manufacture of ear loop 140 to maintain wire 821 in a correct position. As an example, coating 822 may be constructed of a material such as thermoplastic urethane (TPU), another elastomer, including thermoplastic and/or thermoset elastomers, or the like. Ear engagement portion 820 further comprises a section 801 and a section 802 between section 801 and attachment portion 810. As illustrated in FIG. 10, section 801 has a width at least as great as width 1010, and section 802 has a width 1020, where width 1010 is greater than width 1020.

As an example, wire 821 can be flexible or otherwise adjustable such that it can be molded or placed into any shape and retain that shape until it is molded or placed into a different shape, at which time it retains that different shape. Accordingly, the user of headset 100 can mold ear loop 140 into whatever shape is comfortable for either ear, and change that shape at any time according to personal preference. Ear loop 140 is thus customizable for ears of a very wide variety of shapes and sizes.

Figure 11:
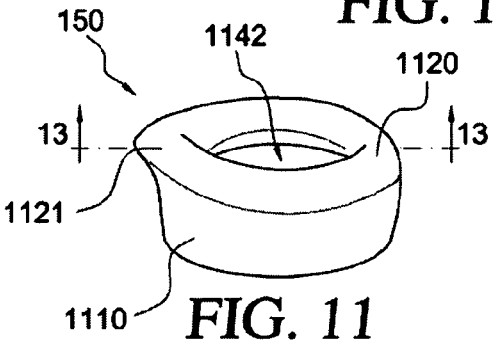
FIG. 11 is a perspective view of an earplug according to an embodiment of the invention.
Figure 12:
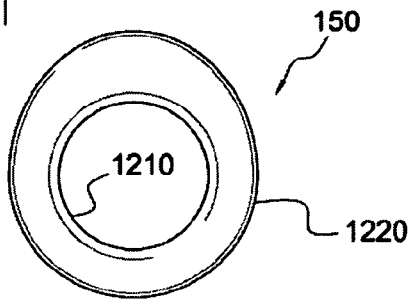
FIG. 12 is a plan view of an earplug according to an embodiment of the invention.

FIGS. 11 and 12 are perspective and plan views, respectively, of earplug 150 according to an embodiment of the invention. As an example, earplug 150 can be manufactured from silicone, another elastomer, including thermoplastic and/or thermoset elastomers, or the like. As illustrated in FIGS. 11 and 12, earplug 150 comprises a neck attachment portion 1110, sometimes also referred to herein as a headset engaging portion, and an ear engaging portion 1120 adjacent to neck attachment portion 1110. Ear engaging portion 1120 of earplug 150 should not be confused with ear engagement portion 820, which is part of ear loop 140 and is first shown in FIG. 8.

Neck attachment portion 1110 comprises a first ring, an upper perimeter of which may be seen in FIG. 12 as circle 1210. Ear engaging portion 1120 comprises a second ring, visible in FIG. 12 as ellipsoid 1220, and having a protruding lip 1121. Protruding lip 1121 interacts with an ear of a user of headset 100 (FIG. 1) in order to stabilize headset 100 in the ear of the user. As an example, protruding lip 1121 can be arranged in the ear so as to fit behind and be stabilized by the tragus, which is the projection of skin-covered cartilage in front of the opening of the ear canal. The stabilization of protruding lip 1121 in this fashion stabilizes earplug 150, and thus all of headset 100, and tends to prevent headset 100 from falling out of or swinging from side to side in the ear.

Figure 13:
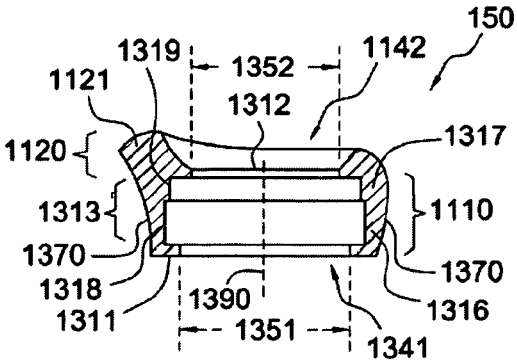
FIG. 13 is a cross-sectional elevational view of the earplug of FIG. 11.
Figure 14:
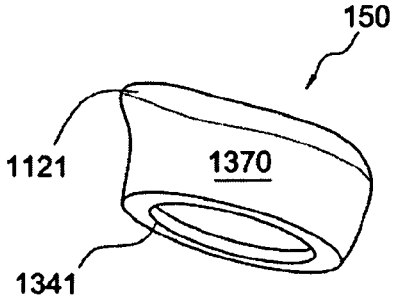
FIG. 14 is a perspective view of an earplug according to an embodiment of the invention.

FIG. 13 is a cross-sectional elevational view of earplug 150 taken at a section line 13-13 in FIG. 11, and FIG. 14 is a perspective view of earplug 150 according to an embodiment of the invention. As illustrated in FIGS. 13 and 14, neck attachment portion 1110 of earplug 150 comprises a floor 1311, a ceiling 1312 substantially opposite floor 1311, and a sidewall 1313 between, substantially perpendicular to, and coupling together floor 1311 and ceiling 1312. Floor 1311 defines an opening 1341 (FIGS. 13-14), and ceiling 1312 defines an opening 1142 (FIGS. 11 and 13). Opening 1410 has a diameter 1351, and opening 1420 has a diameter 1352. In the illustrated embodiment, diameter 1352 is less than diameter 1351. Opening 1410 and opening 1420 are centered on a centerline 1390.

Sidewall 1313 comprises a portion 1316 adjacent to floor 1311 and a portion 1317 between portion 1316 and ceiling 1312. Portion 1316 has an inside surface 1318 and portion 1317 has an inside surface 1319. A thickness of portion 1316 of sidewall 1313 and a thickness of portion 1317 of sidewall 1313 is measured between an outside surface 1370 of neck attachment portion 1110 and, respectively, inside surface 1318 and inside surface 1319. In the illustrated embodiment, the thickness of portion 1316 is less than the thickness of portion 1317, and such would be the case even if, unlike the illustrated embodiment, outside surface 1370 formed a straight sidewall oriented at ninety degrees to floor 1311.

In a non-illustrated embodiment, headset 100 comprises, instead of or in addition to earplug 150, an earplug comprising a neck attachment portion and an ear engaging portion largely as described above but not having a protruding lip. Some users of headset 100 may find such an earplug to be more comfortable because it does not protrude as far into the ear as does earplug 150. In another non-illustrated embodiment, headset 100 comprises, instead of or in addition to earplug 150 and/or the alternate earplug described earlier in this paragraph, an earplug comprising a neck attachment portion and an ear engaging portion largely as described above but having a tapered, funnel-like, or other hollow protrusion in place of a protruding lip. The hollow protrusion could be capable of being partially inserted into the ear canal so as to better direct sound coming from speaker 130 to the eardrum. In addition to those mentioned in this paragraph, other earplug embodiments may also be used in connection with headset 100. All of the described earplugs, including earplug 150, help keep headset 100 in place in or near the ear of a user, improve long-term comfort by spreading the weight of headset 100 over a larger surface area, and help keep ambient noise from entering the ear canal and interfering with the signals emanating from speaker 130.

Figure 15:
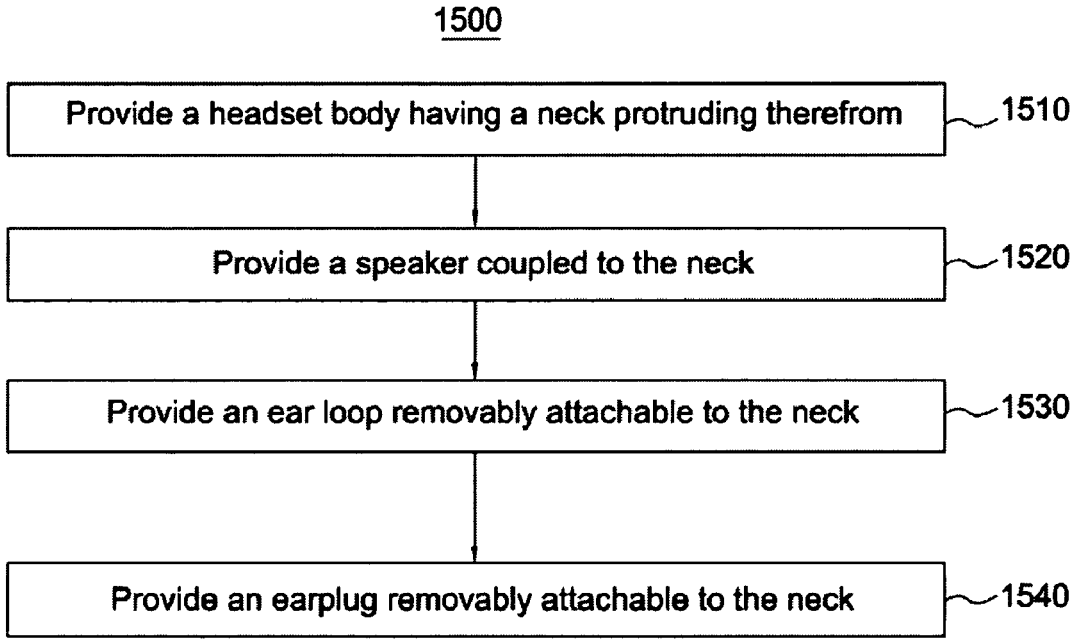
FIG. 15 is a flowchart illustrating a method of manufacturing a headset capable of receiving signals from an electronic device according to an embodiment of the invention.

FIG. 15 is a flowchart illustrating a method 1500 of manufacturing a headset capable of receiving signals from an electronic device according to an embodiment of the invention. A step 1510 of method 1500 is to provide a headset body having a neck protruding therefrom. As an example, the headset body can be similar to body 110, first shown in FIG. 1. As a further example, the neck can be similar to neck 120, first shown in FIG. 1.

A step 1520 of method 1500 is to provide a speaker coupled to the neck. As an example, the speaker can be similar to speaker 130, first shown in FIG. 1.

A step 1530 of method 1500 is to provide an ear loop removably attachable to the neck. As an example, the ear loop can be similar to ear loop 140, first shown in FIG. 1. In one embodiment, step 1530 comprises providing an attachment portion comprising a first lip, a second lip, and a tab between the first lip and the second lip. As an example, the attachment portion can be similar to attachment portion 810, first shown in FIG. 8. As another example, the first lip can be similar to lip 811 and the second lip can be similar to lip 812, both of which are also first shown in FIG. 8. As a further example, the tab can be similar to tab 813, also first shown in FIG. 8.

In the same or another embodiment, step 1530 further comprises providing an ear engagement portion coupled to the attachment portion and comprising a flexible wire and a coating surrounding the flexible wire. As an example, the ear engagement portion can be similar to ear engagement portion 820, first shown in FIG. 8. As a further example, the flexible wire can be similar to wire 821, and the coating can be similar to coating 822, both of which were also first shown in FIG. 8.

A step 1540 of method 1500 is to provide an earplug removably attachable to the neck. As an example, the earplug can be similar to earplug 150, first shown in FIG. 1. In one embodiment, step 1540 comprises providing a headset engaging portion comprising a first ring, and may further comprise providing an ear engaging portion adjacent to the headset engaging portion and comprising a second ring having a protruding lip. As an example, the headset engaging portion can be similar to headset engaging portion or neck attachment portion 1110, first shown in FIG. 11. As a further example, the ear engaging portion can be similar to ear engaging portion 1120, and the protruding lip can be similar to protruding lip 1121, both of which were also first shown in FIG. 11.

Although the invention has been described with reference to specific embodiments, it will be understood by those skilled in the art that various changes may be made without departing from the spirit or scope of the invention. Various examples of such changes have been given in the foregoing description. Accordingly, the disclosure of embodiments of the invention is intended to be illustrative of the scope of the invention and is not intended to be limiting. It is intended that the scope of the invention shall be limited only to the extent required by the appended claims. For example, to one of ordinary skill in the art, it will be readily apparent that the headset discussed herein may be implemented in a variety of embodiments, and that the foregoing discussion of certain of these embodiments does not necessarily represent a complete description of all possible embodiments. Rather, the detailed description of the drawings, and the drawings themselves, disclose at least one preferred embodiment of the invention, and may disclose alternative embodiments of the invention.

All elements claimed in any particular claim are essential to the invention claimed in that particular claim. Consequently, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. A headset capable of receiving signals from an electronic device, the headset comprising:
- a body;
- a neck protruding from the body;
- a speaker coupled to the neck;
- an ear loop removably attached to the neck; and
- an earplug removably attached to the neck;
- wherein:
  - the neck comprises:
    - a first portion; and
    - a second portion between the body and the first portion;
  - the ear loop fits onto the second portion;
  - the earplug fits onto the first portion; and
  - the second portion of the neck comprises:
    - a shaft;
    - an arcuate segment protruding from the shaft and extending around a portion of the shaft;
    - a first groove in the shaft at a first side of the arcuate segment;
    - a second groove in the shaft at a second side of the arcuate segment; and
    - a third groove in the shaft substantially opposite the arcuate segment.

2. The headset of claim 1, further comprising:
- a first magnetic element inside the body and separate from the speaker;
- wherein the first magnetic element comprises at least one of a first magnet or a first component capable of being magnetically attracted.

3. The headset of claim 2 further comprising:
- a rechargeable battery inside the body,
- wherein:
  - the rechargeable battery is capable of being recharged by a charger when the headset is placed in a charging position with respect to the charger;
  - the charger has a second magnetic element therein;
  - the second magnetic element comprises at least one of a second magnet or a second component capable of being magnetically attracted; and
  - the first and second magnetic elements magnetically attract the body and the charger together when the headset is in the charging position.

4. The headset of claim 1 wherein:
- the body comprises:
  - a first side;
  - a second side substantially opposite the first side; and an end cap covering a portion of the first side and a portion of the second side, the end cap having a channel formed therein;

the neck protrudes substantially perpendicularly from the first side;

an intersection of the first side and the second side comprises a raised centerline; and the channel in the end cap fits over the raised centerline.

5. The headset of claim 4 wherein:

the body further comprises:

a first end;

a second end substantially opposite the first end;

a microphone at the first end; and a switch at the second end.

6. The headset of claim 5 wherein:

the switch is capable of one or more of rotational and linear movement.

7. The headset of claim 6 wherein:

the body is an elongated body having a major axis and a minor axis perpendicular to the major axis; and the switch and the microphone are located substantially at opposite ends of the major axis.

8. The headset of claim 1 wherein:

the ear loop comprises:

an attachment portion comprising a first lip, a second lip, and a tab between the first lip and the second lip; and an ear engagement portion coupled to the attachment portion;

the first lip is sized to fit into the first groove and the second groove;

the second lip is sized to fit into the first groove and the second groove; and the tab is sized to fit into the third groove.

9. The headset of claim 8 wherein:

the ear engagement portion comprises:

a wire; and a coating surrounding the wire.

10. The headset of claim 1 wherein:

the earplug comprises:

a neck attachment portion; and an ear engaging portion adjacent to the neck attachment portion;

the neck attachment portion comprises a first ring; and the ear engaging portion comprises a second ring having a protruding lip.

11. A headset capable of receiving signals from an electronic device, the headset comprising:

an elongated body having a major axis and a minor axis perpendicular to the major axis and comprising:

a first side;

a second side substantially opposite the first side;

a first end; and a second end substantially opposite the first end;

an end cap covering a portion of the first side, the first end, and a portion of the second side;

a neck protruding substantially perpendicularly from the first side;

a speaker coupled to the neck;

an ear loop removably attached to the neck;

an earplug removably attached to the neck; and a microphone at the first end;

wherein:

the first end and the second end are located substantially at opposite ends of the major axis;

an intersection of the first side and the second side comprises a raised centerline; and a channel in the end cap fits over the raised centerline and urges the first and second sides toward each other.

12. The headset of claim 11, further comprising:

a first magnetic element inside the elongated body and separate from the speaker.

13. The headset of claim 11 further comprising:

a rechargeable battery inside the elongated body, wherein:

the rechargeable battery is capable of being recharged by a charger when the headset is placed in a charging position with respect to the charger;

the charger has a second magnetic element therein;

the first magnetic element comprises at least one of a first magnet or a first component capable of being magnetically attracted;

the second magnetic element comprises at least one of a second magnet or a second component capable of being magnetically attracted; and the first and second magnetic elements attract together to engage the headset and the charger into the charging position.

14. The headset of claim 11, wherein:

the elongated body further comprises:

a switch at the second end.

15. The headset of claim 11 wherein:

the end cap comprises an enclosure protruding therefrom towards an interior of the elongated body, the enclosure defining an opening; and the microphone rests in the opening.

16. The headset of claim 11 wherein:

the neck comprises:

a first circular portion having a first diameter; and a second circular portion between the elongated body and the first circular portion, the second circular portion having a second diameter different from the first diameter;

the ear loop fits over the second circular portion; and the earplug fits over the first circular portion.

17. The headset of claim 11 wherein:

the neck comprises:

an arc extending around a portion of the neck;

a first groove at a first end of the arc;

a second groove at a second end of the arc; and a third groove between the first groove and the second groove;

the ear loop comprises:

an attachment portion comprising:

a first lip at a first end of the attachment portion;

a second lip at a second end of the attachment portion; and a tab compatible with only the third groove and located between the first lip and the second lip;

and an ear engagement portion coupled to the attachment portion;

and when the ear loop is attached to the neck;

the first lip couples with one of the of the first or second grooves;

the second lip couples with another one of the first or second grooves; and the tab couples with the third groove.

18. The headset of claim 11, wherein:

the earplug comprises:

a headset engaging portion; and an ear engaging portion adjacent to the headset engaging portion;

the headset engaging portion comprises a first ring having a floor, a ceiling, and a sidewall between the floor and the ceiling;

the ear engaging portion comprises a noncircular perimeter having a protruding lip; and the protruding lip is configured to stabilize the headset when coupled against an ear structure proximate to an opening of an ear canal.

19. A headset capable of receiving signals from an electronic device, the headset comprising:

an elongated body having a major axis and a minor axis perpendicular to the major axis and comprising:

a first side;

a second side substantially opposite the first side;

a first end; and a second end substantially opposite the first end;

a neck protruding substantially perpendicularly from the first side;

a speaker coupled to the neck;

an ear loop removably attached to the neck;

an earplug removably attached to the neck; and a microphone at the first end;

wherein:

the first end and the second end are located substantially at opposite ends of the major axis;

the neck comprises:

a first circular portion having a first diameter; and a second circular portion between the elongated body and the first circular portion, the second circular portion having a second diameter different from the first diameter;

the ear loop fits over the second circular portion;

the earplug fits over the first circular portion;

and the second circular portion of the neck comprises:

a shaft;

an arcuate segment protruding from the shaft and extending around a portion of the shaft;

a first groove in the shaft at a first side of the arcuate segment;

a second groove in the shaft at a second side of the arcuate segment; and a third groove in the shaft substantially opposite the arcuate segment.

20. The headset of claim 19 wherein:

the ear loop comprises:

an attachment portion comprising:

a first lip at a first side of the attachment portion;

a second lip at a second side of the attachment portion substantially opposite the first side; and a tab between the first lip and the second lip; and an ear engagement portion coupled to the attachment portion;

the attachment portion is symmetric about an axis passing through the tab; and when the ear loop is attached to the neck:

the first lip fits into the first groove or the second groove;

the second lip fits into the second groove when the first lip is in the first groove and fits into the first groove when the first lip is in the second groove; and the tab fits into the third groove.

21. The headset of claim 20 wherein:

the ear engagement portion comprises:

a flexible wire; and a rubberized coating surrounding the flexible wire.

22. The headset of claim 21 wherein:

the rubberized coating comprises:

a first section;

a second section between the first section and the ear engagement portion; and the first section is wider than the second section.

23. The headset of claim 19, wherein:

the earplug comprises:

a headset engaging portion; and an ear engaging portion adjacent to the headset engaging portion;

the headset engaging portion comprises a first ring having a floor, a ceiling, and a sidewall between the floor and the ceiling; and the ear engaging portion comprises a second ring having a protruding lip.

24. The headset of claim 23, wherein:

the first ring of the headset engaging portion defines a first opening with a first diameter;

the ceiling of the headset engaging portion is substantially opposite the floor and defines a second opening with a second diameter less than the first diameter;

the sidewall of the headset engaging portion is substantially perpendicular to the floor and to the ceiling;

the sidewall comprises:

a first portion adjacent to the floor, the first portion having a first thickness; and a second portion between the first portion and the ceiling, the second portion having a second thickness greater than the first thickness;

the protruding lip is capable of fitting behind a portion of an ear of a user when the headset is in place on the ear of the user.

25. A method of manufacturing a headset capable of receiving signals from an electronic device, the method comprising:

providing a headset body having a neck protruding therefrom;

providing a speaker coupled to the neck;

providing an ear loop removably attachable to the neck; and providing an earplug removably attachable to the neck;

wherein:

providing the headset body comprises providing the neck to comprise:

an arcuate segment around a portion of the neck;

a first groove at a first end of the arcuate segment;

a second groove at a second end of the arcuate segment; and a third groove between the first and second grooves.

26. The method of claim 25 wherein:

providing the ear loop comprises:

providing an attachment portion comprising:

a first lip at a first end of the attachment portion configured to couple with the first groove of the neck, a second lip at a second end of the attachment portion configured to coupled with the second groove of the neck, and a tab configured to couple with the third groove of the neck between the first lip and the second lip to secure the ear loop at a predetermined angle relative to the headset body;

and providing an ear engagement portion coupled to the attachment portion.

27. The method of claim 25 wherein:

providing the earplug comprises:

providing a headset engaging portion comprising a first ring; and providing an ear engaging portion adjacent to the headset engaging portion and comprising a noncircular perimeter having a protruding lip configured to stabilize the headset when the protruding lip is coupled behind a tragus of an ear.

28. The method of claim 25, further comprising:

providing a microphone coupled to the body; and providing an end cap comprising:

a channel covering at least a portion of a centerline defined by an intersection of two opposite sides of the body; and an enclosure defining an opening configured to accommodate the microphone.

29. The method of claim 25, wherein:

providing the headset body comprises:

providing a first magnetic element inside the body and separate from the speaker; and providing a rechargeable battery inside the body;

the first magnetic element comprises at least one of a first magnet or a first component capable of being magnetically attracted;

the rechargeable battery is capable of being recharged by a charger when the headset is placed in a charging position with respect to the charger;

the charger has a second magnetic element therein comprising at least one of a second magnet or a second component capable of being magnetically attracted; and the first and second magnetic elements magnetically attract the headset body and the charger together to maintain the charging position.

30. The method of claim 25, wherein:

providing the headset body comprises:

providing a first magnetic element coupled to the body and independent from the speaker; and providing a rechargeable battery inside the body.

31. The method of claim 25, wherein:

providing the headset body comprises:

providing the neck towards a first end of the headset body; and providing a microphone towards a second end of the headset body, the second end substantially opposite the first end across the headset body.

32. The method of claim 31, wherein:

providing the microphone comprises:

providing an end cap;

coupling the microphone to the end cap; and coupling the end cap to the second end of the headset body.

33. The method of claim 32, wherein:

providing the end cap comprises:

providing a compartment of the end cap;

and coupling the microphone to the end cap comprises:

at least partially housing the microphone in the compartment.

34. The method of claim 25, wherein:

providing the headset body comprises:

providing the neck to comprise:

a first neck portion having a first perimeter; and a second neck portion located between the headset body and the first neck portion, the second neck portion having a second perimeter different than the first perimeter;

and providing the ear loop comprises:

providing the ear loop to couple to the second neck portion.

35. The method of claim 34, wherein:

providing the earplug comprises:

providing the earplug to couple to the first neck portion.

* * * * *

UNITED STATES PATENT AND TRADEMARK OFFICE

CERTIFICATE OF CORRECTION

PATENT NO. : 7,664,287 B2
APPLICATION NO. : 11/031028
DATED : February 16, 2010
INVENTOR(S) : Neu et al.

It is certified that error appears in the above-identified patent and that said Letters Patent is hereby corrected as shown below:

At column 10, line 57, insert a --:-- after the word "neck" and delete the ";"

Signed and Sealed this

Thirteenth Day of April, 2010

David J. Kappos

David J. Kappos
*Director of the United States Patent and Trademark Office*